United States Patent [19]

Garkusha et al.

[11] Patent Number: 4,573,531

[45] Date of Patent: Mar. 4, 1986

[54] METHOD OF UNDERGROUND GASIFICATION OF COAL SEAM

[75] Inventors: Ivan S. Garkusha; Vadim N. Kazak; Valery K. Kapralov, all of Moscow, U.S.S.R.

[73] Assignee: Vsesojuznoe Nauchno-Proizvod-Stvennoe Obiedinenie "Sojuzpromgaz", U.S.S.R.

[21] Appl. No.: 578,527

[22] Filed: Feb. 9, 1984

[30] Foreign Application Priority Data

Feb. 21, 1980 [SU] U.S.S.R. ..... 2887369

[51] Int. Cl.[4] ..... E21B 33/138; E21B 43/247

[52] U.S. Cl. ..... 166/259; 166/50; 166/256; 166/292

[58] Field of Search ..... 166/50, 251, 256, 258, 166/259, 261, 292; 48/DIG. 6

[56] References Cited

U.S. PATENT DOCUMENTS

| | | | |
|---|---|---|---|
| 3,116,792 | 1/1964 | Purre | 166/258 X |
| 3,198,249 | 8/1965 | Willman | 166/261 X |
| 3,208,516 | 9/1965 | Prats | 166/251 X |
| 3,563,606 | 2/1971 | Sears | 166/259 X |
| 4,096,912 | 6/1978 | Lewis et al. | 166/261 X |
| 4,243,101 | 1/1981 | Grupping | 166/261 |
| 4,437,520 | 3/1984 | Stoddard | 166/261 |
| 4,441,554 | 4/1984 | Grupping | 166/261 |
| 4,502,539 | 3/1985 | Grupping | 166/292 X |

FOREIGN PATENT DOCUMENTS

| | | | |
|---|---|---|---|
| 2086930 | 5/1982 | United Kingdom | 166/256 |

*Primary Examiner*—George A. Suchfield

*Attorney, Agent, or Firm*—Steinberg & Raskin

[57] ABSTRACT

A method of underground gasification of a coal seam comprises the steps of opening it by drilling injection and production wells, interconnecting said wells, setting the coal afire and gasifying the coal by supplying a gaseous medium into the first wells and removing the produced gas from the second wells. The seam is gasified successively layer by layer in the direction from the roof of the seam to its bottom. Each subsequent layer is gasified after gasification of the preceding layer is completed and rock overlying the gasified layer is no longer shifted. The thickness of said layer is chosen so that the height of a zone containing cracks formed as a result of rock shift does not exceed the depth of occurrence of the gasified layer.

4 Claims, 3 Drawing Figures

METHOD OF UNDERGROUND GASIFICATION OF COAL SEAM

BACKGROUND OF THE INVENTION

The present invention relates to underground gasification of brown and bituminous coals and may be used in gasification of coal seams under various bedding conditions (at different pitch angles and depths).

The invention may be used to best advantage with coal seams thicker than 5 m.

It may also find applications in underground gasification of oil shales.

With prior art methods of underground gasification of coals, a coal bed is degasified simultaneously throughout its thickness.

However, when a coal bed is degasified simultaneously throughout its thickness in fields characterized by a small ratio of the thickness of the degasified bed, there are formed cracks extending to the surface of the earth due to rock deformation and shifts. Thus, a gaseous medium supplied to effect gasification and the gas formed therewith break through said cracks and fissures.

A known method of underground gasification of coals (cf. U.S. Pat. No. 4,018,481, Cl. 299-4 published in 1977) comprises the steps of opening a coal seam by drilling wells throughout its thickness, interconnecting the wells through a seam hydrofracture, establishing a gasification passage and gasifying the coal by introducing a gaseous medium into a blast passage and removing the produced gas. A disadvantage of the aforesaid method is that, in gasification of thick coal seams deposited near the surface of the earth, there may occur downfalls or the blast and gas may break through cracks and fissures, thereby causing the gasification process to stop.

There is also known a method of underground gasification of coal (cf. U.S. Pat. No. 4,069,867, Cl. 166-256 published in 1978) comprising the steps of opening a coal seam by drilling vertical and inclined holes, interconnecting the holes within the coal seam, establishing gasification passages therein, and gasifying the coal by injecting a gaseous medium into one of the interconnected holes and removing the gas from another hole. A disadvantage of the foregoing method is that, in gasification of thick coal seams deposited at a small depth from the surface of the earth, there may occur downfalls or the blast and gas may break through to the surface of the earth whereby the gasification process is disrupted or stopped.

SUMMARY OF THE INVENTION

The object of the invention is to provide a method of underground gasification of a coal seam ensuring gasification of a thick seam without downfalls or breakthrough of a gaseous agent and gas to the surface of the earth owing to a proper choice of the thickness of a gasified layer and of the seam working sequence.

There is provided a method of underground gasification comprising the steps of determining the depth of occurrence and the thickness of a coal seam, opening it by drilling operating injection and production wells, interconnecting said wells within the coal seam, setting afire the coal, establishing gasification passages therein and gasifying the coal by supplying a gaseous medium into the first wells and removing the produced gas from the second wells, in which according to the invention, the seam is gasified successively layer by layer in the direction from the roof of the coal seam to its bottom, the drilling of the operating holes, their interconnection, the setting of the coal afire and formation of the gasification passages being effected within each layer, gasification of the underlying layer being started after the overlying layer is gasified and the rock overlying the gasified layer is no longer shifted, the shift thereof being caused by the gasification process, the thickness of each gasified layer being chosen so that the height of a zone containing cracks formed as a result of the shift of the overlying rock does not exceed the depth of occurrence of said gasified layer.

It is of advantage that the thickness of said gasified layer should be chosen to satisfy the following relation:

$$m \leqq H/n,$$

where m is the thickness of said gasified layer, m;

H is the thickness of rock overlying the coal seam; and n is an experimental coefficient characterizing properties of the rock overlying the coal seam and accounting for possible propagation of cracks from the degasified space to the surface of the earth.

The method in compliance with the invention makes it possible to gasify thick coal layers successively layer by layer, each layer having a corresponding thickness, an advantage enabling protection of the surface of the earth against penetration of a gaseous medium and gas due to rock shifts. Also, minimum losses are ensured in utilizing coal reserves.

Advantageously, gasification passages in adjacent layers are displaced relative to one another in the seam plane, a feature increasing the degree of utilization of coal reserves and providing minimum losses.

It is also of advantage that the degasified space in the overlying layer of the coal seam should be filled with a suitable stowage material supplied through bore holes, a factor decreasing the effect of rock deformation upon the production process. Furthermore, downfalls will be fewer.

BRIEF DESCRIPTION OF THE DRAWINGS

The invention will now be described in more detail with reference to a specific embodiment thereof, taken in conjunction with the accompanying drawings, wherein.

DESCRIPTION OF THE PREFERRED EMBODIMENTS

The method forming the subject of the present invention is accomplished as follows.

Figure 2:
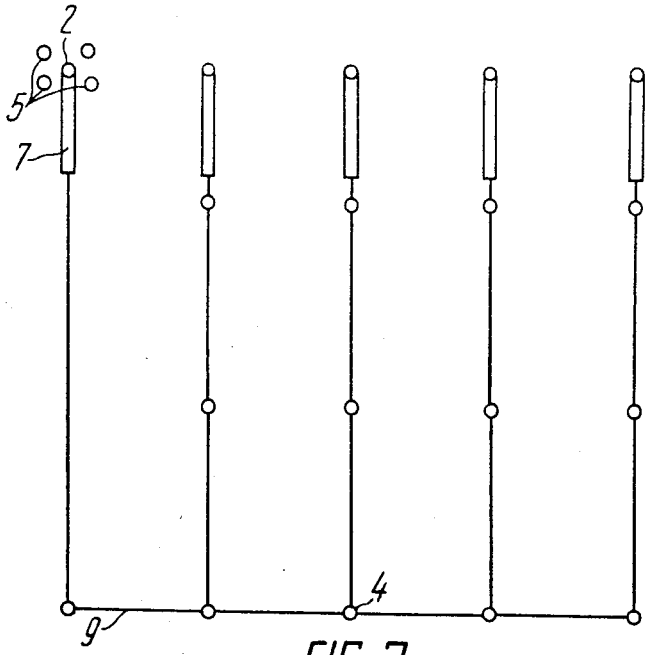
FIG. 2 shows arrangement of production wells in an underground gasification area according to the invention.

A coal seam 1 (FIG. 1) is opened by drilling inclined horizontal wells 2 including a horizontal portion 3 and vertical wells 4, 5 (FIG. 2). The horizontal portion 3 of the well 2 is disposed within a first layer 6 (FIG. 1) of the coal seam, the thickness of said layer being chosen to satisfy the following relation:

$m \leqq H/n$, where m is the thickness of the gasified layer, m;

H is the thickness of rock overlying the coal seam, m;

*n is a coefficient characterizing properties of the* overlying rock and accounting for possible propagation of cracks from the degasified space to the surface of the earth.

The height of a zone wherein cracks occur under different bedding conditions, as applicable to brown and bituminous coal seams, is known from experience gained in underground gasification of coals.

Defining successively the thickness of a gasified layer, we find the height of said zone wherein cracks occur by multiplying the coefficient n into the thickness of said layer and, subsequently, compare the obtained value with the depth of occurrence of said layer, H. With the height of said zone wherein cracks occur being smaller than the depth of occurrence of said layer, we determine the thickness of the gasified layer of interest.

The value of the coefficient n is known from experience gained in underground gasification of coals under different geological conditions. It generally depends on physical and mechanical properties of rock overlying a coal bed, the thickness of said coal bed (or a layer) and on gasification conditions.

Figure 1:
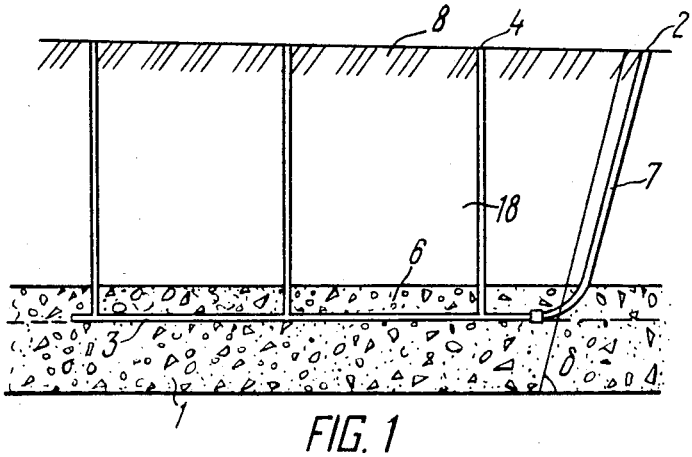
FIG. 1 is an elevation of a coal seam prepared for gasifying a first layer according to the invention.
Figure 3:
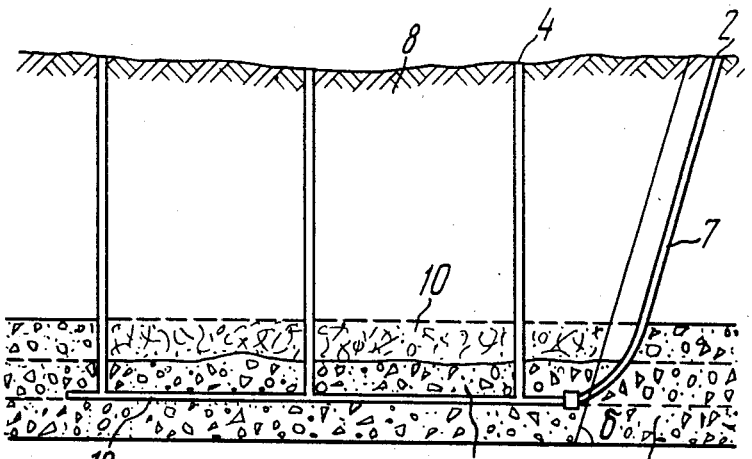
FIG. 3 is an elevation of the coal seam prepared for gasifying a second layer.

To enable better understanding of the invention, a corresponding reference numeral in FIGS. 1, 2 and 3 denotes only one of a multitude of operating wells since said wells are essentially similar.

An inclined portion 7 of the wells 2 is drilled beyond a zone wherein overlying rock 8 is shifted (the boundaries of the rock shift zone are defined by a line drawn at a rock shift angle $\delta$), said inclined portion being encased by metal tubes up to a point at which the well enters the coal seam.

The number of vertical wells 4 depends on the work area.

The vertical wells 4 are interconnected in the coal seam with the horizontal portions 3 of the wells 2 through a hydrofracture or a pyrogenous connection.

Thereafter initial reaction (gasification) passages are established. A gaseous medium is supplied successively or simultaneously to the inclined horizontal wells 2, the gas being removed through the wells 4 in a fire row 9 farthest from the wells 2.

Under said conditions the coal is set afire and reaction (gasification) passages are established up to that portion of the wells which is encased by tubes.

The vertical wells 4 are interconnected with the horizontal portions 3 of the wells 2 through a hydrofracture or a pyrogenous connection. The gas is removed through the well 2 and a group of the gas-outlet wells 5 interconnected with the well 2.

An underground gas producer is fired as follows. In the central well in the row 9 the coal seam is set afire by any known method. Simultaneously the gas medium is supplied to the other wells. The gas is removed through the central well 4 in the row 9.

As the fire reaches the wells adjoining the central well 4 in the row 9, the gas medium is no longer supplied to the wells adjoining the central well, said gas medium being supplied simultaneously to the extreme wells in the row 9, while the gas is removed through the other wells in the row 9. As the fire reaches the extreme wells in the row 9, a firing passage is established by fire over the entire length. Also, said passage and all the inclined horizontal wells 2 are hydraulically interconnected.

To establish initial reaction (gasification) passages, said gas medium is supplied simultaneously or successively to the inclined horizontal wells, the gas being removed through the wells in the fire row 9.

Under the specified conditions the coal is set afire and reaction (gasification) passages 3 are established up to the casing tubes in the inclined portion 7 of the wells 2. Also, a pyrogenous connection is provided between the vertical wells 5 (FIG. 2) and the passage in the adjacent inclined well 2. Thus, all the vertical and inclined horizontal wells of the underground gas producer are interconnected within the coal seam as a result of setting the coal afire and establishing by fire all the necessary passages within said coal seam. Thereafter the coal seam 1 is gasified. When the coal seam is set afire and the reaction passages are established by fire, the gaseous medium used is an air blast or an oxygen-enriched air under a varying pressure depending on the depth of occurrence of the coal seam 1 and its physical and chemical properties.

The coal seam 1 is gasified in sections of the reaction passage between the vertical wells from the wells in the row 9 to the inclined portion 7 of the wells 2. The gaseous medium is supplied to the wells 4 and the gas is removed through the vertical wells 5 and the well 2 nearest thereto, the gas being initially cooled from 500°–600° to 200° C. by watering it on the face of the gas-outlet wells 5 and 2.

When the gasification process is over, a hydraulic stowage material is supplied to the degasified space 10 in the upper layer 6 through the wells 4. For stowage, use may be made of forest loam found on the surface of a coal field or of dump rock. A mixing plant is erected in the vicinity of the gas producer. Loams or other rocks are washed using a monitor and a water jet under pressure.

After the degasified space in the upper layer 6 is filled, a second layer 11 (FIG. 3) is prepared and gasified in accordance with the position of the wells in the upper layer 6, passages 12 in the upper layer 11 being displaced in plan in the seam plane relative to similar channels in the upper layer 6. The coal in the layer 11 is gasified in a manner similar to that described above.

Thus, the entire coal seam 1 is gasified layer by layer from the roof of the seam to its bottom.

The proposed method allows gasification of thick coal beds without any hazard of a blast and gas penetrating to the surface of the earth through cracks in overlying rock.

What is claimed is:

1. A method of underground gasification of a coal seam, comprising the steps of:

determining the depth of occurrence and the thickness of a coal seam;

opening said coal seam by drilling operating injection and production wells therein;

interconnecting said wells within said coal seam;

forming gasification passages within said coal seam; and igniting said coal and gasifying the same by supplying a gaseous medium through said injection wells and removing the produced gas from said production wells, said coal seam being gasified successively layer by layer from the roof of said coal seam to the bottom thereof, the drilling of said operating wells, their interconnection, the igniting of the coal and formation of said gasification passages being effected successively within each layer from top to bottom with gasification of each under-layer being started after the overlying layer is gasified and no shifting occurs in the rock overlying the gasified layer, shifting thereof resulting from the gasification of the layer supporting the rock, the thickness of each gasified layer being chosen so that the height of a zone containing cracks formed as a result of the shift of the overlying rock does not exceed the depth of said gasified layer.

2. A method as claimed in claim 1, wherein the thickness of the gasified layer is chosen to satisfy the following relation:

$$m \leqq H/n,$$

where m is the thickness of the gasified layer, m;

H is the thickness of rock overlying the coal seam, m;

n is a coefficient characterizing the height of the zone in which cracks are formed over the degasified space.

3. A method as claimed in claim 2, wherein the gasification passages in adjacent layers are displaced relative to one another in the seam plane.

4. A method as claimed in claim 3, characterized in that the degasified space in the overlying layer of said coal seam is filled with a suitable stowage material supplied through the wells.

* * * * *